US009903284B1

(12) United States Patent
Lavertu et al.

(10) Patent No.: US 9,903,284 B1
(45) Date of Patent: Feb. 27, 2018

(54) DUAL-FUEL ENGINE SYSTEM AND METHOD HAVING THE SAME

(71) Applicant: General Electric Company, Schenectady, NY (US)

(72) Inventors: Thomas Michael Lavertu, Niskayuna, NY (US); Roy James Primus, Niskayuna, NY (US); Venu Gummadavelli Gupta, Hanover Park, IL (US); Sebastian Walter Freund, Garching b. Muenchen (DE); Omowoleola Chukwuemeka Akinyemi, Niskayuna, NY (US); Adam Edgar Klingbeil, Niskayuna, NY (US); Victor Manuel Salazar, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 15/338,941

(22) Filed: Oct. 31, 2016

(51) Int. Cl.
*F02D 19/08* (2006.01)
*F02M 26/47* (2016.01)
(Continued)

(52) U.S. Cl.
CPC ..... *F02D 19/08* (2013.01); *F02D 41/005* (2013.01); *F02D 41/0027* (2013.01);
(Continued)

(58) Field of Classification Search
CPC ..... F02D 19/08; F02D 41/00; F02D 41/005; F02D 41/0027; F02D 41/38; F02D 2041/389; F02M 26/23; F02M 26/47
See application file for complete search history.

(56) References Cited

U.S. PATENT DOCUMENTS 4,548,175 A * 10/1985 Kawai ..... F01L 1/26 123/188.14
6,561,157 B2 5/2003 zur Loye et al.
(Continued)

FOREIGN PATENT DOCUMENTS

JP 2014020263 A * 2/2014 ..... F02D 19/08
WO 2015054657 A1 4/2015

OTHER PUBLICATIONS

Qian et al., "Research of the influence of combustion chamber structure on performance of dual fuel engine", Electric Information and Control Engineering (ICEICE), pp. 2498-2500, Apr. 15-17, 2011, Wuhan.

(Continued)

*Primary Examiner* — Hieu T Vo
(74) *Attorney, Agent, or Firm* — Pabitra K. Chakrabarti

(57) ABSTRACT

Dual-fuel engine system includes cylinders in which the cylinders have an intake valve and an exhaust valve that control a flow of fluid into and out of a combustion chamber of the corresponding cylinder. The intake valve is configured to have an intake valve closure (IVC) timing. The dual-fuel engine system is configured to operate in a single-fuel mode and a dual-fuel mode. The combustion chamber and a piston are designed to provide a compression ratio. The dual-fuel engine system also includes one or more processors that are operably coupled to and configured to control operation of the first fuel injector. The compression ratio and the IVC timing are selected to achieve a target pre-combustion temperature. The target pre-combustion temperature permits the dual-fuel engine system to operate at a high substitution rate in the dual-fuel mode and at a sufficient fuel efficiency in the single-fuel mode.

20 Claims, 5 Drawing Sheets

(51) Int. Cl.
*F02M 26/33* (2016.01)
*F02D 41/00* (2006.01)
*F02D 41/38* (2006.01)

(52) U.S. Cl.
CPC ..... *F02D 41/38* (2013.01); *F02M 26/33* (2016.02); *F02M 26/47* (2016.02); *F02D 2041/389* (2013.01)

(56) References Cited

U.S. PATENT DOCUMENTS

| | | | |
|---|---|---|---|
| 6,814,032 | B2 | 11/2004 | Goto |
| 8,794,212 | B2 | 8/2014 | Klingbeil et al. |
| 8,851,050 | B2 * | 10/2014 | Shishime ..... F02D 13/0238 123/406.29 |
| 9,109,545 | B2 | 8/2015 | Klingbeil et al. |
| 9,145,837 | B2 | 9/2015 | Klingbeil |
| 9,145,838 | B2 | 9/2015 | Finn et al. |
| 9,194,344 | B1 | 11/2015 | Foege |
| 9,201,409 | B2 | 12/2015 | Kumar et al. |
| 9,228,506 | B2 | 1/2016 | Gokhale et al. |
| 9,249,744 | B2 | 2/2016 | Klingbeil |
| 9,279,350 | B2 | 3/2016 | Yeager et al. |
| 2011/0288744 | A1 | 11/2011 | Gokhale et al. |
| 2012/0222400 | A1 | 9/2012 | Walker et al. |
| 2014/0358404 | A1 | 12/2014 | Lavertu et al. |
| 2014/0373530 | A1 | 12/2014 | De Ojeda |
| 2015/0176509 | A1 | 6/2015 | Lavertu et al. |
| 2015/0198070 | A1 | 7/2015 | Record et al. |
| 2015/0240738 | A1 | 8/2015 | Yerace et al. |
| 2016/0069287 | A1 | 3/2016 | Lavertu et al. |
| 2016/0108873 | A1 | 4/2016 | Jackson et al. |
| 2016/0153375 | A1 | 6/2016 | Klingbeil |
| 2016/0169142 | A1 | 6/2016 | Klingbeil et al. |

OTHER PUBLICATIONS

Carlucci et al., "Combustion and emissions control in diesel—methane dual fuel engines: The effects of methane supply method combined with variable in-cylinder charge bulk motion", Energy Conversion and Management, vol. 52, Issues: 8-9, pp. 3004-3017, Aug. 2011.

* cited by examiner

DUAL-FUEL ENGINE SYSTEM AND METHOD HAVING THE SAME

FIELD

The subject matter described herein relates to dual-fuel engine systems and to mechanisms for controlling operation of the dual-fuel engine system.

BACKGROUND

Engines include a plurality of cylinders having combustion chambers with pistons disposed in the combustion chambers. Intake air is directed into the combustion chambers by air handling systems of the engines and is compressed in the combustion chambers. Fuel is injected into the combustion chambers at a fuel injection time and is ignited. The ignited fuel generates pressure in the combustion chamber that moves the piston. The ignition of the fuel creates gaseous exhaust in the combustion chambers that is at least partially carried out of the engine by the air handling systems.

Emission standards have been created to reduce pollutions from emissions into the environment. One of these standards is referred to as the Tier 4 emission standard. Manufacturers have utilized a dual-fuel engine that injects a combination of diesel fuel and natural gas into the combustions chamber for ignition. In particular, by substituting natural gas in for diesel, less diesel fuel is used improving emissions.

While emissions are improved, problems remain. Specifically, natural gas, a diesel fuel substitute in a dual-fuel engine, is combustible. With a diesel engine, the air in the combustion chamber is compressed to increase the temperature of the air within the combustion chamber to such a temperature that upon introduction of the diesel fuel ignition occurs without the need of an external spark. Thus, diesel engines are extremely efficient and high compression ratios within the cylinder are desired. Because the diesel fuel is the catalyst for ignition, injection of natural gas into the combustion chamber must occur prior to injecting the diesel fuel. This is problematic because the natural gas can ignite before the diesel fuel is added at high enough pre-combustion temperatures within the combustion chamber. This is referred to as knocking, which can cause catastrophic failure to the engine.

BRIEF DESCRIPTION

In an embodiment, a dual-fuel engine system is provided that includes a plurality of cylinders in which the cylinders of said plurality have an intake valve and an exhaust valve that control a flow of fluid into and out of a combustion chamber of the corresponding cylinder. The intake valve configured to have an intake valve closure (IVC) timing. The dual-fuel engine system also including first and second fuel injectors that are configured to inject first and second fuels, respectively, into the combustion chamber. The dual-fuel engine system is configured to operate in a single-fuel mode in which only the second fuel is provided to the combustion chamber and a dual-fuel mode in which the first and second fuels are provided to the combustion chamber. The first fuel injector is configured to inject the first fuel at a substitution rate. The dual-fuel engine system also includes a piston configured to move within the combustion chamber. The combustion chamber and the piston are designed to provide a compression ratio. The dual-fuel engine system also includes one or more processors that are operably coupled to and configured to control operation of the first fuel injector. The compression ratio and the IVC timing are selected to achieve a target pre-combustion temperature (or operating range of pre-combustion temperatures). In some embodiments, the target pre-combustion temperature permits the dual-fuel engine system to operate at a high substitution rate in the dual-fuel mode and at a sufficient fuel efficiency in the single-fuel mode.

In some aspects, the dual-fuel engine system also includes a heat exchanger and an exhaust gas recirculation (EGR) manifold that receives exhaust from the dual-fuel engine system. The heat exchanger cools the exhaust to provide recirculated gas. The recirculated gas is mixed with air from outside of the dual-fuel engine system and provided to the plurality of cylinders. Optionally, the recirculated gas is provided to the plurality of cylinders at an EGR rate selected by the one or more processors. Optionally, the first fuel injector is configured to control the substitution rate of the first fuel based on an operating pre-combustion temperature during operation. Optionally, the one or more processors are configured to determine the operating pre-combustion temperature within the cylinders based on at least one of a temperature sensor at the air manifold, a temperature sensor in one of the one or more cylinders, or a temperature sensor at an exhaust gas recirculating manifold.

In some aspects, the compression ratio is between 11 and 15. In certain aspects, the compression ratio is less than 14.5 or, more particularly, less than 14. The compression ratio may be a geometric compression ratio or an effective compression ratio.

In some aspects, the intake valve is configured to close between 515-540 crank angle degrees of a 720 degree crank cycle or 620-645 crank angle degrees of a 720 degree crank cycle.

In some aspects a maximum percentage of the substitution rate is configured to be at least 75% for the predetermined baseline conditions and the fuel efficiency in the single-fuel mode is at least 40% for the predetermined baseline conditions.

In some aspects, the compression ratio is a geometric compression ratio. The IVC timing and the geometric compression ratio being fixed based on hardware used to manufacture the dual-fuel engine system.

In some aspects, at least one of the IVC timing and the compression ratio may be selected by the one or more processors during operation of the dual-fuel engine system.

In an embodiment, a method of designing a dual-fuel engine is provided. The method includes providing a plurality of cylinders in which the cylinders of said plurality have an intake valve and an exhaust valve that are configured to control a flow of fluid into and out of a combustion chamber of the cylinder. The method also includes operably coupling first and second fuel injectors to the cylinders. The first and second fuel injectors are configured to inject first and second fuels into the combustion chamber. The dual-fuel engine system is configured to operate in a single-fuel mode in which only the second fuel is provided to the combustion chamber and a dual-fuel mode in which the first and second fuels are provided to the combustion chamber. The first fuel injector is configured to inject the first fuel at a substitution rate. The method also includes providing a piston configured to move within the combustion chamber and selecting a compression ratio and an intake valve closure (IVC) timing relative to each other to achieve a target pre-combustion temperature (or operating range of pre-combustion temperatures). In some embodiments, the target pre-combustion temperature permits the dual-fuel engine system to operate at a high substitution rate in the dual-fuel mode and at a sufficient fuel efficiency in the single-fuel mode.

In some aspects, the method also includes operably coupling a heat exchanger and an exhaust gas recirculation (EGR) manifold that receives exhaust from the dual-fuel engine system. The heat exchanger is configured to cool the exhaust from the dual-fuel engine system to provide recirculated gas such that the recirculated gas is mixed with air from outside of the engine and provided to the plurality of cylinders.

In some aspects, the compression ratio is between 11 and 15. In certain aspects, the compression ratio is less than 14.5 or, more particularly, less than 14. The compression ratio may be a geometric compression ratio or an effective compression ratio.

In some aspects, the intake valve is configured to close between 515-540 crank angle degrees of a 720 degree crank cycle or 620-645 crank angle degrees of a 720 degree crank cycle.

In some aspects, the compression ratio is between 11 and 15, a maximum percentage of the substitution rate is configured to be at least 75%, and the fuel efficiency in the single-fuel mode is at least 40%.

In some aspects, one or more processors are configured to select at least one of the IVC timing and the compression ratio during operation of the dual-fuel engine system.

In some aspects, the first fuel injector is configured to control the substitution rate of the first fuel based on a pre-combustion temperature during operation.

In an embodiment, a method of operating a dual-fuel engine is provided. The method includes providing a dual-fuel engine system that includes a plurality of cylinders in which the cylinders have an intake valve and an exhaust valve that control a flow of fluid into and out of a combustion chamber of the cylinder. The dual-fuel engine system also includes first and second fuel injectors configured to inject first and second fuels into the combustion chamber. The first fuel injector is configured to inject the first fuel at a substitution rate. The dual-fuel engine system also includes a piston configured to move within the combustion chamber. The method also includes operating the dual-fuel engine system in a single-fuel mode in which only a second fuel is provided to the combustion chamber and a dual-fuel mode in which the first and second fuels are provided to the combustion chamber. The cylinders have a compression ratio and the intake valves has an intake valve closure (IVC) timing that are selected to achieve a target pre-combustion temperature (or operating range of pre-combustion temperatures). In some embodiments, the target pre-combustion temperature permits the dual-fuel engine system to operate at a high substitution rate in the dual-fuel mode and at a sufficient fuel efficiency in the single-fuel mode.

In some aspects, operating the dual-fuel engine system includes controlling an exhaust gas recirculation (EGR) rate of recirculated gas that is provided to the dual-fuel engine and controlling the substitution rate of the first fuel based on a pre-combustion temperature during operation.

In some aspects, the compression ratio is between 11 and 15, a maximum percentage of the substitution rate is configured to be at least 75%, and the intake valve is configured to close between 515-540 crank angle degrees of a 720 degree crank cycle about the axis of a crank shaft or 620-645 crank angle degrees of a 720 degree crank cycle.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
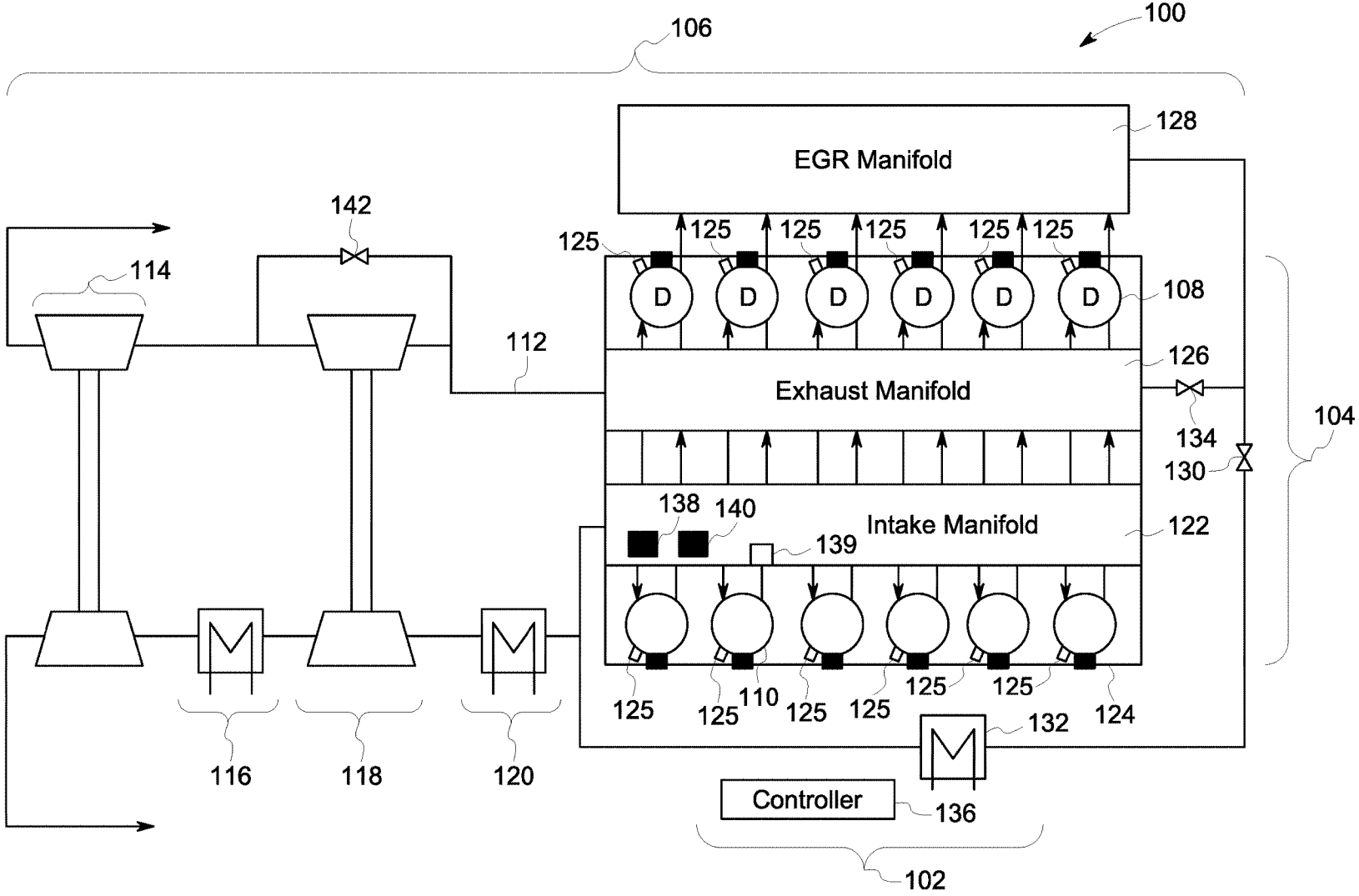
FIG. 1 is a schematic diagram of a dual-fuel engine system in accordance with one embodiment.

Embodiments set forth herein include a dual-fuel engine system that enables a high substitution rate and a sufficient fuel efficiency (or fuel consumption) for the intended purpose of the dual-fuel engine system. At least one application of various embodiments is a locomotive engine, although it is contemplated that the dual-fuel engine systems may be used for other purposes. The substitution rate may be defined as the fraction of total fuel energy at combustion that is provided by a substitute fuel replacing a primary fuel. The fuel efficiency, which may also be referred to as the thermodynamic fuel efficiency or the brake thermal efficiency (BTE), may be determined by known methods. BTE may be calculated from brake specific fuel consumption (BSFC), which is inversely related to fuel efficiency. At least some embodiments may have a fuel efficiency of at least 40%. At least some embodiments may have a BSFC of at most 205 g/kWh.

As one example, the primary fuel utilized is diesel fuel and the substitute gas is natural gas. In some embodiments, the gas substitution rate can be such that natural gas is responsible for up to and greater than 85% of the energy created by the combustion. As a result, emissions are reduced to ensure the dual-fuel engine remains within designated emission standards. For example, embodiments may satisfy Tier 4 standards of the United States Environmental Protection Agency (EPA) as of 2016. In some embodiments, the dual-fuel engine is designed to have a compression ratio and an intake valve closure (IVC) timing that provide a target pre-combustion temperature, such as at baseline operation (e.g., operating at ambient temperatures). In particular embodiments, the dual-fuel engine system operates according to multiple engine cycles, such as the multi-stroke (e.g., four) engine cycle, and is adapted to use a Miller cycle.

During normal operation of the dual-fuel engine, an operating pre-combustion temperature may change in response to changing operating conditions (e.g., changing intake temperature or exhaust gas recirculation (EGR) rate). It may move within an operating pre-combustion range during normal operation. The pre-combustion range may enable a high substitution rate (e.g., greater than 75%). In certain embodiments, the pre-combustion range may also enable low fuel consumption and/or low emissions. In particular embodiments, the dual-fuel engine may selectively control the substitution rate based on one or more engine parameters. Optionally, the dual-fuel engine may also dynamically adjust the IVC timing and/or the compression ratio to achieve the target pre-combustion temperature. Whether the IVC timing and/or compression ratio are dynamically controlled, at least some embodiments may reduce and eliminate early ignition of the substitute gas or knocking by the engine.

The dual-fuel engine system is designed to achieve a target pre-combustion temperature. This may also be characterized as being designed to achieve a target operating range of pre-combustion temperatures during normal operation of the dual-fuel engine system. The target pre-combustion temperature may be configured to occur at, for example, predetermined baseline conditions of the dual-fuel engine system. For example, hardware of the dual-fuel engine system may be selected to have a designated compression ratio and a designated IVC timing. The compression ratio and IVC timing are selected so that the target pre-combustion temperature is achieved when, for example, operating at predetermined baseline conditions. Because the operating range of pre-combustion temperatures that may occur during operation are based on the target pre-combustion temperature, the target pre-combustion temperature may be selected to permit a high substitution rate (e.g., a maximum value of 70% or more) in the dual-fuel mode.

Although the compression ratio and the IVC timing are selected to permit a high substitution rate in the dual-fuel mode, the compression ratio and the IVC timing also allow the dual-fuel engine system to operate at a sufficient fuel efficiency (e.g., 40% or more) in the single-fuel mode. While designing the dual-fuel engine system, a geometric compression ratio, which is determined by the hardware of the engine, is selected that makes it possible to achieve a sufficient fuel efficiency (or fuel consumption). A desired substitution rate (or desired operating range of substitution rates) may be used to calculate a target pre-combustion temperature (or an operating range of pre-combustion temperatures). The target pre-combustion temperature may then be used to determine the IVC timing given the inlet temperature and the expected composition of the fuel mixture. The air-handling system may then be configured to provide a sufficient amount of air to effectively burn the fuel required to generate the power.

During operation of the dual-fuel engine, the control system may monitor parameters, such as the operating pre-combustion temperature and EGR rate, and adjust other parameters, such as the substitution rate, the IVC timing, and the compression ratio (e.g., geometric or effective) to control and/or improve engine performance. The target pre-combustion temperature (or operating range of pre-combustion temperatures) allows the substitution rate to remain relatively high compared to other known dual-fuel engines. U.S. Patent Application Publication No. 2016/0069287 A1 and U.S. Patent Application Publication No. 2016/0169142 A1, each of which is incorporated herein by reference in its entirety, describe subject matter that may be used to control embodiments of the present application.

The engine control system can provide a fuel consumption reduction upgrade kit for an engine with components that are compatible with, and enabling for, a high natural gas substitution rate dual-fuel option which is implemented at the time of the fuel economy upgrade or at a later date without further changes to the base engine hardware. Because the engine control system can be provided as a retrofit upgrade kit, down time for upgrading a currently existing engine system is reduced. After the upgrade, the engine system allows for both diesel only and natural gas operation to provide very high efficiency while still having a low charge temperature that is cool enough to prevent knocking despite the high substitution rates of a substitute gas. In some embodiments, an engine control system utilizes engine parameters to determine an operating pre-combustion temperature at which a fuel (e.g., diesel fuel or another type of fuel) is supplied such that a substitute gas within the combustion chamber does not ignite until the fuel introduced into the combustion chamber is injected and combusts. The pre-combustion temperature prior to combustion may be a function of a number of parameters, including gas composition, which includes one or more fuels and may include exhaust gas recirculation (EGR), air, and potentially other matter. The pre-combustion temperature may also be a function of compression ratio, timing of valve events, intake manifold temperature, among other things. The pre-combustion temperature for an engine cycle is determined based on information representative of different parameters of the engine. These parameters can include operating engine parameters that are detected by the control system during operation of the engine, such as a temperature of an air intake manifold, a temperature of an EGR manifold, a percentage of EGR versus outside air going to the air intake manifold, temperatures of turbochargers, temperatures of air exiting heat exchangers, engine speed, cylinder temperature, and the like. In addition, these parameters can include predetermined or known engine parameters based on a design of the engine. The predetermined engine parameters may be stored into the control system or affect an algorithm or lookup table that is used to control the substitution rate. The predetermined engine parameters may include an air intake valve timing, a cam profile, a compression ratio, a volumetric efficiency, and the like. In addition, desired volumetric efficiency of an engine cycle may be determined where volumetric efficiency is the actual amount of air the engine system utilizes compared to a theoretical upper limit on mass flow rates of air, fuel, and both into and out of the combustion chamber.

Based on at least one operating engine parameter and, optionally, one or more predetermined engine parameters, the control system determines the operating pre-combustion temperature. It should be understood that "determining" the operating pre-combustion temperature includes (a) detecting the pre-combustion temperature using one or more sensors; (b) calculating the pre-combustion temperature based on other information; or (c) determining a control metric (e.g., temperature of air intake) that is associated with the pre-combustion temperature. Accordingly, the determination of the operating pre-combustion temperature may be by directly detecting the operating pre-combustion temperature. The determination of the operating pre-combustion temperature may also be by directly calculating (e.g., using an algorithm) the pre-combustion temperature based on one or more operating engine parameters, predetermined engine parameters, and/or other information. The determination of the operating pre-combustion temperature may also be performed by using a database (e.g., lookup table). For example, one of the operating engine parameters may be applied to a lookup table, which then retrieves a substitution rate of the first fuel based on the operating engine parameter. This lookup table may be constructed based on the operating pre-combustion temperature. In other words, the substitution rates are based on the operating pre-combustion temperature in order to reduce the likelihood of knocking.

The one or more processors of the engine control system may be provided with predetermined ranges for pre-combustion temperature, volumetric efficiency, percentage of EGR rate, and the like, to determine the desired IVC timing and/or compression ratio of the combustion chamber and to determine the amount of fuels to be injected during a cycle. The compression ratio is the ratio of the volume of the combustion chamber from a largest capacity to a smallest capacity of the combustion chamber. The effective compression ratio of the engine system can vary from cycle to cycle depending on the timing of the closure of the air intake valve. By closing the air intake valve prior to a bottom dead center (BDC) of a piston stroke, or between 515-540 crank angle degrees of a 720 degree crank cycle about the axis of a crank shaft, the effective compression ratio of the combustion chamber can be reduced as required by the engine control system. Alternatively, the intake valve can be closed after BDC and after the point of maximum volumetric efficiency, to reduce the effective compression ratio. The range of interest is between 620-645 crank angle degrees of a 720 degree crank cycle.

It should be understood that the term "compression ratio," without further modification or qualification, includes in its scope a geometric compression ratio or an effective compression ratio. The "geometric compression ratio" is the ratio of the largest volume in the combustion chamber to the smallest volume of the combustion chamber. The smallest volume is the volume between the piston and the cylinder head when the piston is at top dead center (TDC). The geometric compression ratio is typically established by hardware of the engine. However, mechanisms exist that can selectively change the smallest volume and, consequently, the compression ratio. In other embodiments, however, the effective compression ratio is changed during operation in dual-fuel mode. The effective compression ratio is the compression ratio that is actually experienced by the fuel mixture and engine and is a function of the geometric compression ratio and the IVC timing. The geometric compression ratio sets a maximum value of the effective compression ratio. Manipulation of the IVC timing can effectively reduce the compression ratio experienced during operation. A variety of mechanism exist for varying the IVC timing and, consequently, changing the effective compression ratio.

In particular embodiments, the IVC timing and the geometric compression ratio are set at the design stage of the engine. In other words, the IVC timing and the geometric compression ratio are fixed for certain embodiments. In such embodiments, the IVC timing and the geometric compression ratio are selected to achieve a target pre-combustion temperature, such as for baseline conditions. In such embodiments, the IVC timing and the geometric compression ratio are determined by hardware that forms the cylinder and/or engine. This hardware, however, may also permit the dual-fuel engine to have a sufficient fuel efficiency during operation in the single-fuel mode.

In other embodiments, the IVC timing and/or the compression ratio are capable of being manipulated and are selected during operation of the dual-fuel engine. Such embodiments are described in greater detail below.

In some embodiments, the engine control system (or simply "control system) may be an embedded system or include one or more embedded systems that are configured to perform the steps described herein. For example, one or more embedded systems may control the components and devices of the engines based on information obtained from sensors. As used herein, an "embedded system" is a specialized computing system that is integrated as part of a larger system, such as an engine or a machine that includes the engine (e.g., locomotive). Embedded systems are unlike general computers, such as desktop computers, laptop computers, or tablet computers, which may be programmed or re-programmed to accomplish a variety of disparate tasks.

The control system may include a combination of hardware and software components that form a computational engine that will perform one or more specific functions, such as controlling the engine based on an operating pre-combustion temperature. The control system may include one or more processors (e.g., microcontroller or microprocessor) or other logic-based devices and memory (e.g., volatile and/or non-volatile). The memory may include, for example, a lookup table. The control system may optionally include one or more sensors, actuators, user interfaces, analog/digital (AD), and/or digital/analog (DA) converters. The control system may include a clock that is used by the control system for performing its intended function(s), recording data, and/or logging designated events during operation.

The control system may be configured to operate in time-constrained environments that require the embedded systems to make complex calculations that a human would be unable to perform in a commercially reasonable time. Embedded systems may also be reactive such that the embedded systems change the performance of one or more mechanical devices in response to detecting an operating condition (e.g., changing the substitution rate based on pre-combustion temperature).

FIG. 1 is a schematic diagram of a dual-fuel engine system 100 having an engine control system 102 in accordance with one embodiment. The dual-fuel engine system 100 includes a dual-fuel engine 104 and an air handling system 106. The dual-fuel engine 104 includes several cylinders 108, 110 that operate according to multiple engine cycles to generate power, such as the multi-stroke (e.g., four) engine cycle described above (that will be described in greater detail below). Alternatively, the engine may operate with a different number of strokes such as a two-stroke engine. The cylinders 108 may be donating cylinders that recirculate the exhaust gas back into the intake manifold (described below). The cylinders 110 may be non-donating cylinders from which the exhaust is not recirculated. Alternatively, a different number and/or arrangement of the cylinders 108 and/or 110 may be provided, including an engine that does not include any donating cylinders 108. In the illustrated embodiment, the dual-fuel engine 104 includes twelve (12) cylinders (six donating cylinders 108 and six non-donating cylinders 110), although it is contemplated that embodiments may have more or fewer cylinders.

The air handling system 106 includes several conduits 112 that direct air and exhaust through the dual-fuel engine 104. The conduits 112 direct air from outside the dual-fuel engine system 100 into a primary or first turbocharger 114 of the air handling system 106, through a first heat exchanger 116 that cools the air, optionally through a secondary or second turbocharger 118, optionally through a second heat exchanger 120 that cools the air, and into an intake manifold 122 of the air handling system 106. The air in the intake manifold 122 may include air from outside the dual-fuel engine system 100 and/or recirculated exhaust. The air in the intake manifold 122 is directed into the cylinders 108, 110 (e.g., during engine cycles of the cylinders 110).

Several first fuel injectors 124 of the dual-fuel engine system 100 receive a first fuel from a first fuel tank (not shown) and injects fuel into the cylinders 108, 110. In one embodiment, the first fuel is natural gas. In addition, several second fuel injectors 125 of the dual-fuel engine system 100 receive a second fuel from a second fuel tank (not shown) and inject fuel into the cylinders 108, 110. In one embodiment, the second fuel is diesel fuel. In one embodiment, the first fuel injectors 124 are mounted in the intake ports of the intake manifold 122 while the second fuel injectors 125 direct the fuel directly into the cylinders 108, 110. Alternatively, the first fuel injectors 124 are mounted in the cylinder head next to the inlet valve while the second fuel injectors 125 direct the fuel directly into the cylinders 108, 110. In this manner, the dual-fuel engine system 100 is able to operate in a single-fuel mode in which only one fuel, such as diesel fuel is solely injected to provide performance advantages, and additionally in a dual-fuel mode in which two or more fuels, such as diesel fuel and natural gas, are injected into the combustion chamber to reduce emissions outputted by the dual-fuel engine system 100 (e.g., relative to the first mode or another mode).

Exhaust from the cylinders 110 is directed by the conduits 112 of the air handling system 106 into an exhaust manifold 126 of the air handling system 106. Exhaust from the cylinders 108 is directed into an EGR manifold 128 of the air handling system 106, and then is directed by the conduits 112 and an optional valve 130 into a third heat exchanger 132 to cool the exhaust. The cooled exhaust is directed by the conduits 112 back into the intake manifold 122 as recirculated gas, where the recirculated gas is mixed with air from outside of the dual-fuel engine 104. Optionally, another valve 134 may direct some exhaust back into the exhaust manifold 126. Exhaust in the exhaust manifold 126 may be directed by the conduits 112 back into the second turbocharger 118, then into the first turbocharger 114, and then out of the dual-fuel engine system 100. Alternatively, another valve 142 may be used to cause the exhaust to bypass the second turbocharger 118. Optionally, the engine may not include an EGR manifold 128 and/or the exhaust from the cylinders 108 may not be recirculated.

The control system 102 includes a controller 136 and sensors 138, 139 and 140 operably coupled with the controller 136. For example, the controller 136 may communicate with the sensors 138, 139 and 140 via one or more wired and/or wireless connections. The controller 136 can represent hardware circuitry that includes and/or is connected with one or more processors (e.g., one or more microprocessors, field programmable gate arrays, integrated circuits, etc.) that perform operations described herein. In one embodiment, the controller 136 is specially programmed to perform the operations described herein, such as according to a flowchart of one or more embodiments of methods described herein.

The sensors 138, 139 or 140 may be located within the intake manifold 122 of the air handling system 106 to measure characteristics of the air (e.g., air from outside the engine system and/or recirculated exhaust) that flows into the intake manifold 122 for being directed into the cylinders 108, 110. Optionally, one or more of the sensors 138, 139 or 140 may be located outside of the intake manifold 122, such as at an inlet to the intake manifold 122, in the conduit 112 leading into the intake manifold 122, or another location. Also optionally, one or more of the sensors 138, 139 or 140 may be located within the exhaust gas recirculating manifold 128. Also optionally, one or more of the sensors 138, 139 or 140 may be located within or be coupled with the fuel injectors 124 and 125 or the cylinders 110. In yet another embodiment one or more of the sensors may be a knock sensor.

In one embodiment, the sensor 138 is a temperature sensor that measures temperatures of the air in or going into the intake manifold 122, the sensor 139 is a temperature sensor that measures temperature of the air in or going into the EGR manifold 128 and sensors 140 are mass flow sensors that are coupled with or included in the fuel injectors 124 and 125 that monitor the rates of fuel flow from the fuel injectors 124 and 125 and sensors within or associated with the cylinders 108 and 110 to monitor air mass flows through the cylinders 108 and 110. Optionally, one or more of the sensors 138, 139 or 140 may be located elsewhere, such as at or within the outlet of the compressor of the second turbocharger 118, in one or more conduits through which exhaust of the cylinders 108, 110 flows, in one or more components of the exhaust gas recirculation system, etc.

The sensors 138, 139 or 140 may include thermocouples that generate potentials representative of temperatures or changes in temperature in the air, a thermometer, or another device that can sense temperature and generate an output signal to the controller 136 that indicates temperature. The controller 136 may monitor air mass flow through cylinders 108 and 110. Optionally, the controller 136 may monitor the rates of fuel flow from the fuel injectors 124 from mass flow sensors that are coupled with or included in the fuel injectors 124 and 125. Alternatively, the fuel injectors 124 and 125 may communicate the rates at which fuel flows from the fuel injectors 124 and 125 to the controller 136.

In one embodiment, the controller 136 may receive both temperature and air mass flow rate measurements from the sensors 138, 139 and 140. Alternatively, the controller 136 may receive only temperature measurements or only air mass flow rate measurements, but not both temperature and air mass flow rate measurements. The controller 136 examines the temperature measurements and mass flow rates to determine a pre-combustion temperature and determine volumetric efficiency prior to combustion of fuel within cylinders 108, 110.

For example, the controller 136 may determine the pre-combustion temperature in the cylinder. The controller 136 may also determine if the pre-combustion temperature falls within a predetermined range. Similarly, the controller 136 may also determine the volumetric efficiency and determine if the volumetric efficiency falls within a predetermined range. For instance, in the example, when the dual-fuel engine system 100 is operating in a dual-fuel injection mode the combination of the intake valve timing and compression ratio result in a pre-combustion temperature in a range between 1220-1230° F. (660-665° C.) and a volumetric efficiency in a range between 70%-80%. In such an instance, the controller 136 actuates the first and second fuel injectors 124 and 125 to inject fuel at a predetermined ratio. In an example when the first fuel is a substitute fuel, the predetermined ratio can be 85% of the substitute fuel and 15% of the second fuel by percent of energy resulting from the fuel upon combustion. In other examples, the fuel ratio can be 90% of the first fuel and 10% of the second without falling outside of this disclosure. In yet another example the fuel ratio can be 1% of the first fuel and 99% of the second fuel.

The controller 136 can calculate the pre-combustion temperature from temperature measurements to determine the amount of fuel to be injected into the cylinders 108 and 110 from each of the injectors 124 and 125 during each engine cycle. In this manner, the controller 136 ensures the amount of a first fuel (such as natural gas) is not at a volume such that the pre-combustion temperature within the cylinders 108 and 110 ignites the first fuel before the addition of the second fuel resulting in undesirable knocking within the dual-fuel engine system 100. In this manner also, as the dual-fuel engine system 100 wears and intake manifold 122 temperatures increase or exhaust gas recirculating efficiency decreases, the controller 136 is able to dynamically adjust the ratio of the first and second fuel injected into the cylinders 108 and 110. In this manner the controller 136 does not have to rely solely on a knock sensor, increasing the likelihood a knock is avoided.

In one embodiment, the controller 136 only determines pre-combustion temperature to determine the ratio of the first and second fuel injected into the cylinders 108 and 110. Calculations are made utilizing any method, including but not limited to utilizing an algorithm. In another embodiment, the controller 136 only determines the volumetric efficiency to determine the ratio of the first and second fuel injected into the cylinders 108 and 110. In another embodiment, the controller 136 calculates the pre-combustion temperature and determines volumetric efficiency to determine the ratio of first and second fuel injected into the cylinders 108 and 110. Optionally, another property of the dual-fuel engine system 100 is calculated or determined that is not pre-combustion temperature or volumetric efficiency to determine the ratio of the amounts of the first and second fuels to be injected into the cylinders 124 and 125.

While the description herein focuses on fuel injection for the cylinders 108, 110 during one cycle of the dual-fuel engine system 100, the controller 136 makes the calculations utilized to determine the ratio of fuel injected into the cylinders 108 and 110 for each engine cycle. For example, during a first engine cycle the controller may calculate a pre-combustion temperature in a range requiring the ratio of the first fuel to second fuel to be approximately 85% to 15% by energy generated; whereas in the next engine cycle the temperature within the intake manifold 122 could increase, resulting in the controller 136 calculating a pre-combustion temperature in a different range resulting in a ratio of first fuel to second fuel to be approximately 80% to 20% by energy generated in the second cycle. In this manner, cycle to cycle the controller 136 is able to dynamically increase or decrease the ratio of the first fuel to the second fuel to prevent early ignition of the first fuel in the cylinders 108 and 110 resulting in knocking due to dynamic changes in the conditions of the dual-fuel engine system 100.

Figure 2:
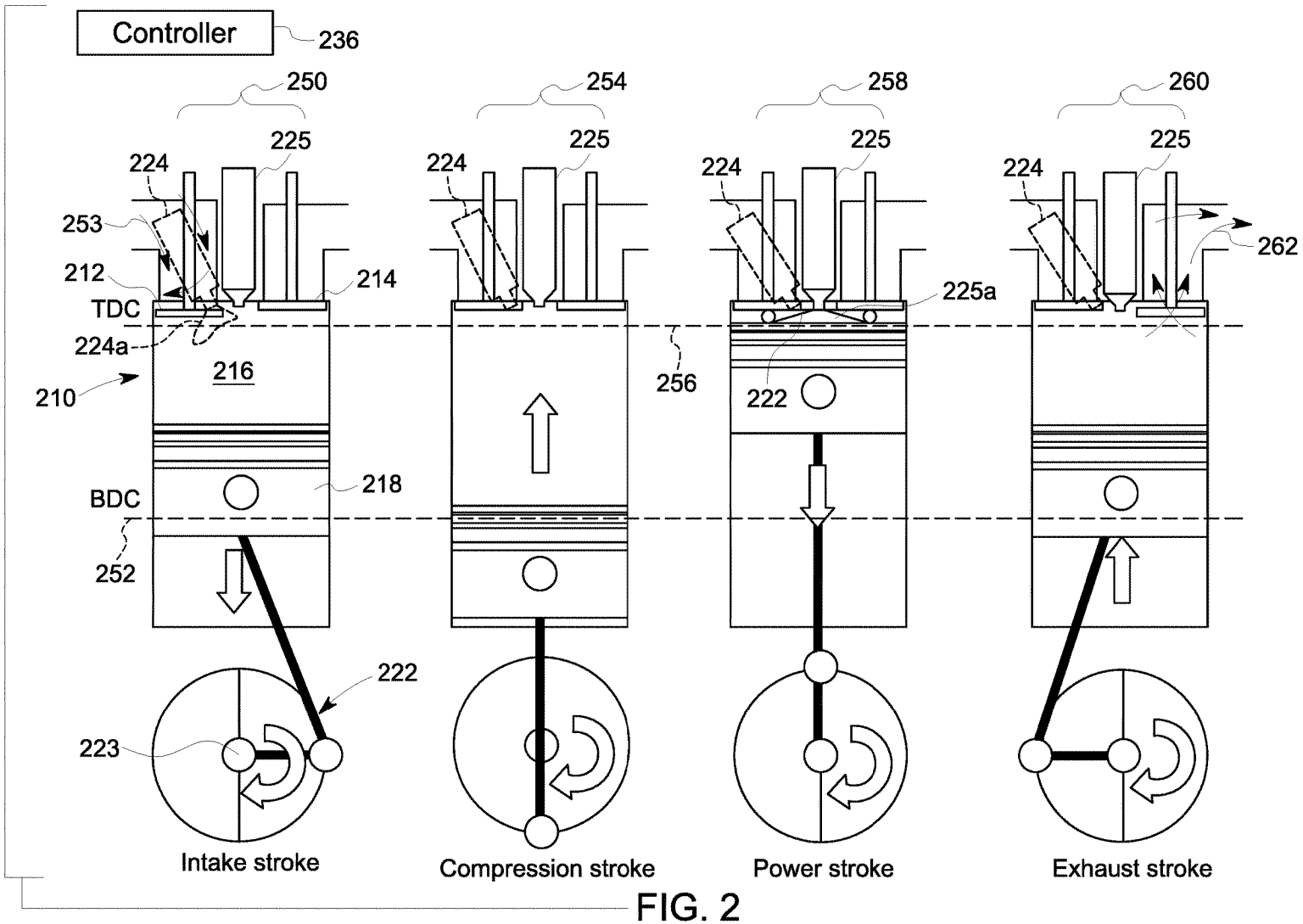
FIG. 2 illustrates a four-stroke engine cycle for a cylinder in a dual-fuel engine system according to one example.

FIG. 2 illustrates a four-stroke engine cycle for a cylinder 210 that utilizes a dual injection system according to one example. The cylinder 210 can represent one or more of the cylinders 108, 110 shown in FIG. 1. The cylinder 210 includes an intake valve 212 and exhaust valve 214 that control the flow of air and exhaust into and out of a combustion chamber 216. A piston 218 reciprocates within the chamber 216 driving the rotation of a crankshaft 222 about an axis 223. First and second fuel injectors 224 and 225 can represent one or more of the first and second fuel injectors 124 and 125 also shown in FIG. 1. The first and second fuel injectors 224 and 225 inject first and second fuels 224*a* and 225*a* respectfully into the combustion chamber 216. The intake valve 212, exhaust valve 214 and first and second fuel injectors 224 and 225 are each controlled by and are operably connected to a controller 236 that can represent the controller 136 shown in FIG. 1. The controller 236 may have one or more processors that control operation of the first and second fuel injectors 224, 225.

The controller 236 operates the cylinder 210 in two different modes, one in which only one fuel is injected into the combustion chamber 216 and a second in which the first and second fuel injectors 224 and 225 inject first and second fuels 224*a* and 225*a* into the combustion chamber 216. The controller 236 continuously monitors parameters of the engine system to determine if a substitute fuel needs to be added into the combustion chamber 216 to decrease emissions to ensure the engine system is falling within a predetermined range, such as within a range as defined by Tier 4 standards.

When operating in the first mode, during an intake stroke 250 of the four-stroke engine cycle, the piston 218 moves downward toward a BDC location or position 252 within the combustion chamber 216. Air 253 also is received into the combustion chamber 216 through the intake valve 212 during the intake stroke 250. The controller 236 then closes the intake valve 212 at bottom dead center 252. Specifically, the controller 236 ensures that no fuel is injected into the combustion chamber 216 at this time.

When still operating in the single-fuel mode, compression stroke 254 of the four stroke engine cycle, the piston 218 moves upward from the BDC location or position 252 in the combustion chamber 216 toward a top dead center (TDC) location or position 256 in the combustion chamber 216 increasing the temperature of the compressed air. Late in the compression stroke 254, fuel is injected into the combustion chamber 216 above the piston 218. The fuel can be injected during the injection beginning late in the compression stroke 254 and into a power stroke 258, or during only the power stroke 258. The fuel is injected to create an air-and-fuel mixture within the combustion chamber 216. This mixture ignites to cause combustion within the combustion chamber 216 of the cylinder 210. The piston 218 is moved downward from the TDC position 256 toward the BDC position 252.

In particular embodiments, the dimensions of the cylinder 210 and piston 218 that determine the compression ratio may be selected and the IVC timing may be selected (or controlled) such that the dual-fuel engine operates at a designated fuel efficiency. For example, the designated fuel efficiency may be at least 40%. The compression ratio and the IVC timing may also achieve a target pre-combustion temperature (or an operating range of pre-combustion temperatures) as described below.

When the controller 236 determines a substitution of fuel is desired the controller 236 operates in the dual-fuel mode where the controller determines a predetermined ratio of first and second fuels based on energy released from the fuels. During the intake stroke 250 of the four-stroke engine cycle, the piston 218 moves downward toward the bottom dead center (BDC) location or position 252 within the combustion chamber 216. Air is received into the combustion chamber 216 through the intake valve 212 during the intake stroke 250 similar to as described above. However, in the dual-fuel mode an amount of a first fuel 224*a* is injected through the first fuel injector 224 to provide an air and fuel mixture within the combustion chamber 216. For example, in one embodiment the first fuel is a substitute fuel such as natural gas. In the example, the amount of natural gas injected into the combustion chamber causes at least 70% of the energy from the combustion when the combustion within the combustion chamber 216 occurs. In certain embodiments, a maximum substitution rate may be at least 70%, at least 75% or, more particularly, at least 80%. In certain applications, the maximum substitution rate may be at least 85% or, more particularly, at least 90%.

The controller 236 monitors engine parameters including data and information received from sensors that can represent sensors 138, 139 and 140 as shown in FIG. 1 to make determinations, including calculations, such as the pre-combustion temperature of fuel prior to combustion, volumetric efficiency and the like. In one example, in an embodiment where a 720-degree engine cycle occurs about axis 223, the closure occurs between 515-540 crank angle degrees. By closing the intake valve 212 before the BDC position 252, the amount of air within the combustion chamber 216 is reduced relative to closing the intake valve 212 at the BDC position 252, thus reducing the compression ratio. By reducing the compression ratio, the pre-combustion temperature within the cylinder 210 is reduced to prevent the mixture of the air and first fuel from combusting before introduction of the second fuel, eliminating undesired combustion or knocking during the compression stroke 254. As an example, in one embodiment, the compression ratio is above 12 and below 15. In certain embodiments, an effective compression ratio is 13 and below. In some embodiments, the IVC timing during the dual-fuel mode is fixed. In other embodiments, the controller 236 may control operation of the dual-fuel engine to adjust the IVC timing.

When still operating in the second mode, during the compression stroke 254 of the four stroke engine cycle, the piston 218 moves upward from the BDC location or position 252 in the combustion chamber 216 toward the TDC location or position 256 in the combustion chamber 216 increasing the temperature of the compressed air. Late in the compression stroke 254, an amount of second fuel 225*a* from the second fuel injector 225 is injected into the combustion chamber 216 above the piston 218. In one example, the second fuel is a primary fuel such as diesel fuel. In this example, the amount of diesel fuel injected causes 15% of the energy from the resulting combustion. The second fuel 225*a* can be injected during the injection beginning late in the compression stroke 254 and into a power stroke 258, or during only the power stroke 258. The second fuel 225*a* is injected to create an air-and-dual fuel mixture within the combustion chamber 216. This mixture is ignited as a result of ignition of the second fuel to cause combustion within the combustion chamber 216 of the cylinder 210. The piston 218 is moved downward from the TDC position 256 toward the BDC position 252.

During an exhaust stroke 260 of the four stroke engine cycle, whether operating in the first mode or second mode, the piston 218 moves upward from the BDC position 252 toward the TDC position 256 of the intake stroke 252. During this movement, exhaust 262 from inside the combustion chamber 216 is forced out of the cylinder 210 by the upward movement of the piston 218.

Figure 3:
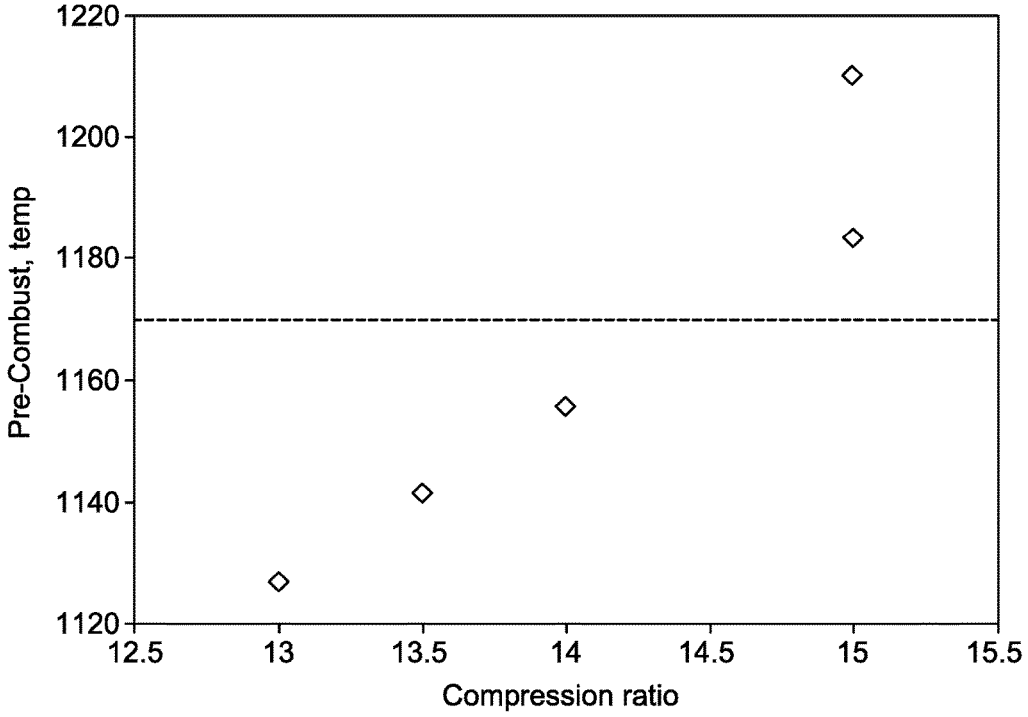
FIG. 3 illustrates a relationship between compression ratio and pre-combustion temperature in a dual-fuel engine system.

FIG. 3 illustrates a relationship between compression ratio and pre-combustion temperature in a dual-fuel engine system. In FIG. 3, the intake manifold air temperature (MAT) is 140° F. (60° C.), EGR is 30%; intake manifold air pressure (MAP) is about 63 pounds per square inch absolute (psia) (434,370 Pascal); and engine speed is 900 rpm. Below the dashed line indicates a high substitute rate region. As illustrated in FIG. 3, the pre-combustion temperature reduces as the compression ratio reduces. A lower compression ratio, such as 14.5 or 14.0 or lower, may be associated with a higher substitution rate.

Figure 4:
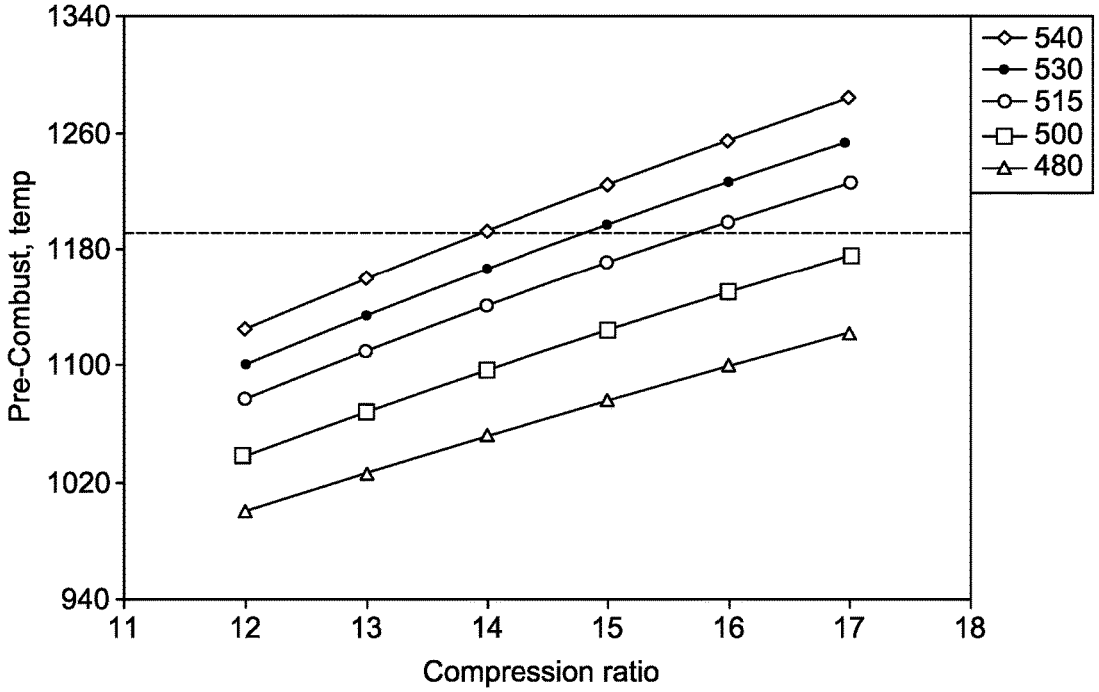
FIG. 4 illustrates relationships among compression ratio, pre-combustion temperature, and intake valve closure (IVC) timing (or crank angle) in a dual-fuel engine system.

FIG. 4 illustrates relationships among compression ratio, pre-combustion temperature, and IVC timing (or crank angle) in a dual-fuel engine system. In this example, the intake MAT is 140° F. (60° C.) and the EGR is 30%, and the baseline IVC timing of the multi-stroke dual-fuel engine is 580. The dashed line indicates a pre-combustion temperature for a substitution rate of 80%. As illustrated in FIG. 4, the pre-combustion temperature reduces as the IVC timing moves further away from the IVC timing of a 540 crank angle. More specifically, the crank angles of 530, 512, 500, 480 correspond to reduced pre-combustion temperatures.

Figure 5:
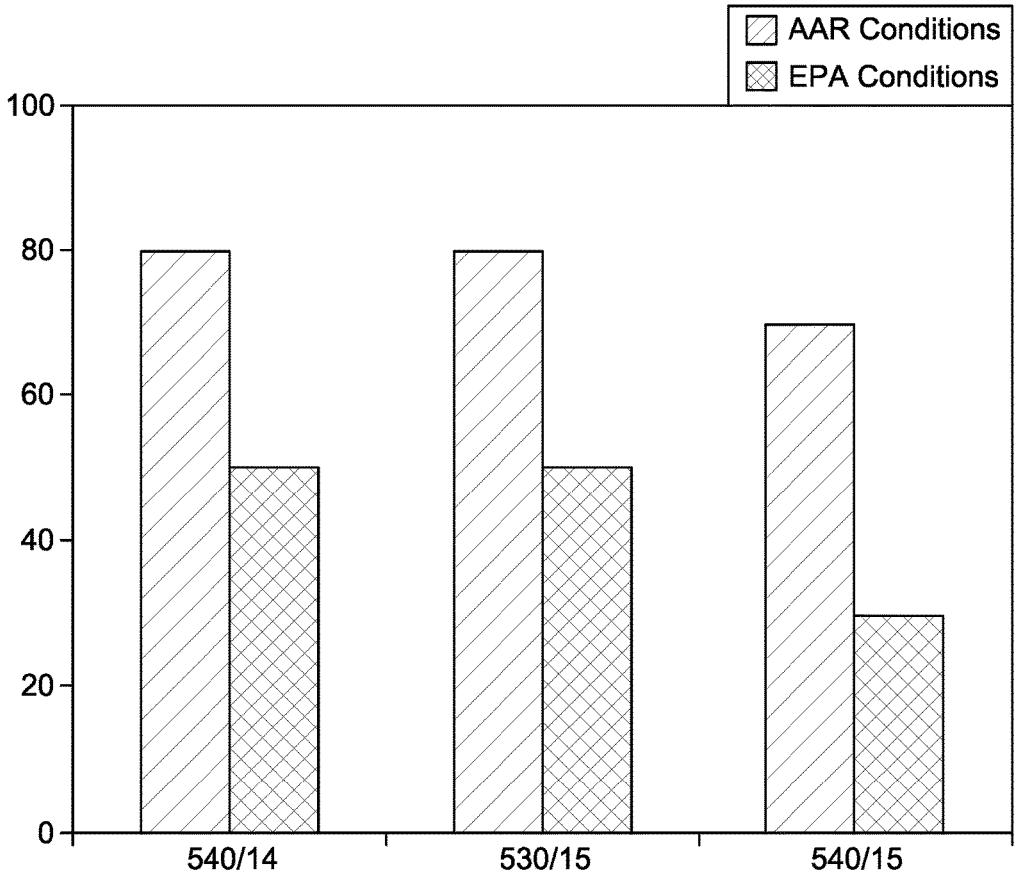
FIG. 5 compares performances of different combinations of crank angle (or IVC timing) and compression ratio for dual-fuel engine systems under different standard conditions.

FIG. 5 compares performances of different combinations of IVC timing (or crank angle) and compression ratio for dual-fuel engine systems under different standard conditions. The vertical axis represents a maximum substitution rate (by percentage) achieved by the different combinations. The bar on the left of each pair indicates a maximum substitution rate under the conditions specified by Association of American Railroads (AAR), which include ambient temperature ($T_{amb}$) being 105° F. (40.56° C.), an altitude being 1000 feet (304.8 meters), and the intake MAT being 140° F. (60° C.). The bar on the right of each pair indicates a maximum substitution rate under the conditions specified by the United States EPA, which include ambient temperature ($T_{amb}$) being 105° F. (40.56° C.); an altitude being 7000 feet (2,134 meters), and the intake MAT being 170° F. (76.67° C.). The predetermined baseline conditions may be the same as those conditions specified by AAR or the European Railway Agency (ERA). As illustrated in FIG. 5, either reducing the IVC timing (e.g., moving further away from the baseline IVC timing) or reducing the compression ratio may correspond to greater substitution rate. A combination of reduced IVC timing and compression ratio may also correspond to a greater substitution rate.

Accordingly, the compression ratio and the IVC timing are selected to achieve a target pre-combustion temperature. The target pre-combustion temperature may permit the dual-fuel engine system to operate at a high substitution rate in the dual-fuel mode and at a sufficient fuel efficiency in the single-fuel mode. By way of example, the compression ratio may be between 11 and 15. The intake valve may be configured to close between 515-540 crank angle degrees of a 720 degree crank cycle or 620-645 crank angle degrees of a 720 degree crank cycle. In other words, the IVC timing may be configured to close between 515-540 crank angle degrees of a 720 degree crank cycle or 620-645 crank angle degrees of a 720 degree crank cycle. The 515-540 crank angle range may be for an early Miller cycle. The 620-645 crank angle range may be for a later Miller cycle.

Embodiments may include a variety of types of dual-fuel engines. In particular embodiments, the dual-fuel engine system is a locomotive diesel engine that satisfies Tier 4 emission standards of the United States Environmental Protection Agency as of 2016. A maximum percentage of the substitution rate may be at least 75% for the predetermined baseline conditions. The fuel efficiency in the single-fuel mode may be greater than 40% for the predetermined baseline conditions. Full power operation may be 24 horsepower per liter of displacement.

In some embodiments, the IVC timing may be controlled using one or more different mechanisms. As an example, an eccentric may be coupled to the follower and may change the relative phasing. As another example, a hydraulic lifter can be used. In other embodiments, a cam phasor may be used to index the cam shaft to the crank shaft. In other embodiments, a separate cam shaft may be used for intake and a separate cam shaft may be used for exhaust. In such instances, the engine may utilize dual cam phasors to index the cam shafts.

Figure 6:
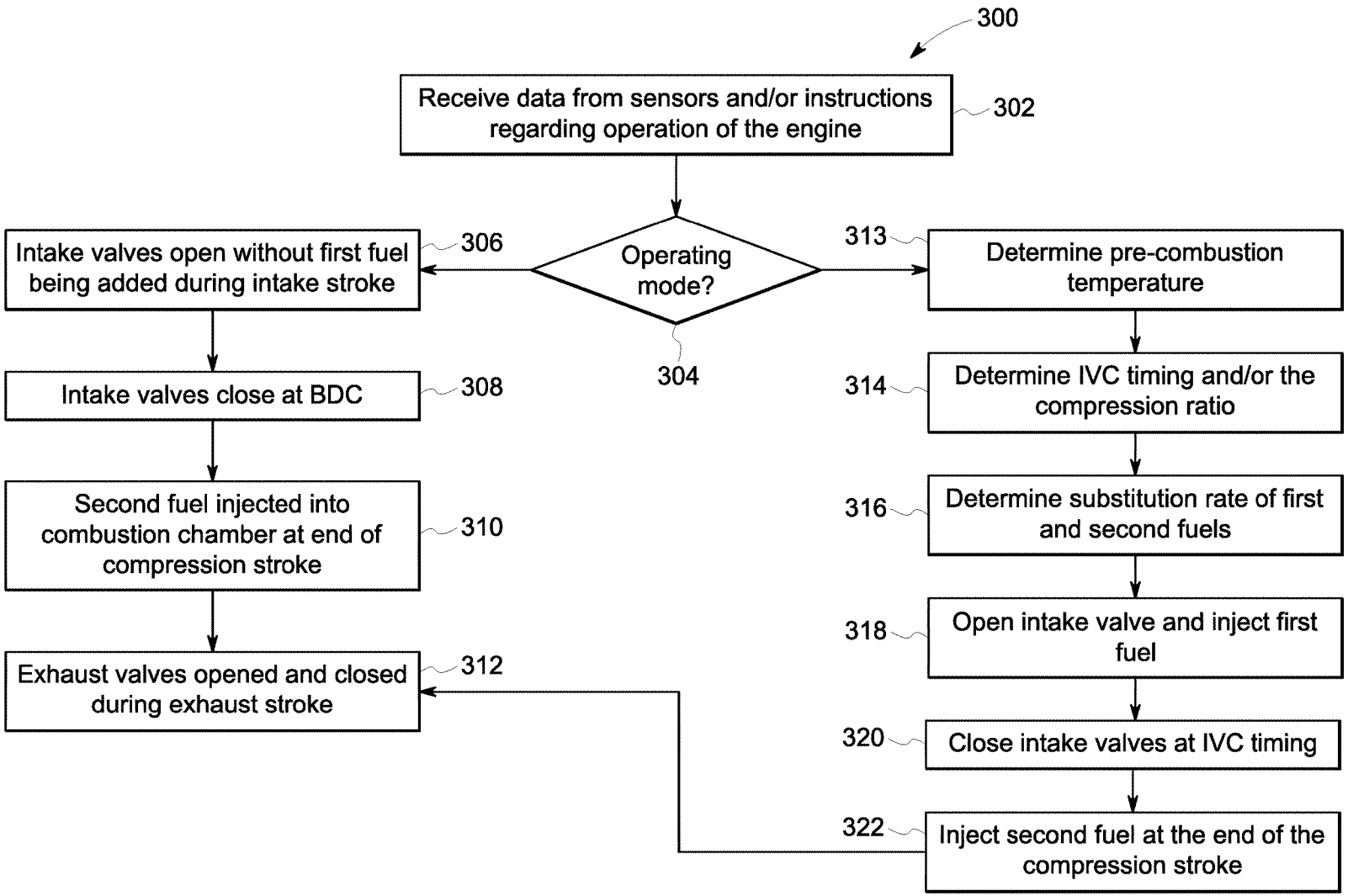
FIG. 6 illustrates a flowchart of one embodiment of a method for controlling operation of an engine system.

FIG. 6 illustrates a flowchart of one embodiment of a method 300 for controlling operation of a dual-fuel engine system. The method 300 may include monitoring engine parameters in the dual-fuel engine 104 and, based on the engine parameters, controlling the IVC timing, compression ratio, and/or the amount of fuel injected by the first and second fuel injectors into the cylinders 108, 110 of the engine 106. In certain embodiments, the method 300 reduce or eliminate risk of undesired knocking while providing improved emission control. The flowchart may represent programming of or may be used to program the controller 136 or 236 to perform the operations described herein in one embodiment.

At 302, the controller receives data from sensors and/or instructions regarding operation of the dual-fuel engine. At

304, the controller may decide whether the engine will operate in a single-fuel mode or in a dual-fuel mode during, for example, the next engine cycle. If the engine will operate in a single-fuel mode, at 306, the intake valves are opened by the controller to start the intake stroke and a first fuel is not injected into the combustion chambers during the intake stroke. At 308, the intake valves are closed at BDC by the controller and the compression stroke begins. At 310, at the end of the compression stroke the second fuel from the second fuel injector is injected into the combustion chamber by the controller causing ignition and combustion of the air and fuel mixture within the combustion chamber to provide the power stroke. At 312, the controller opens and closes the exhaust valves during the exhaust stroke before a new cycle begins.

If the decision, at 304, is to operate the engine in a dual-fuel mode, then the controller selects an IVC timing and/or compression ratio for operation during the dual-fuel mode. In some embodiments, at 313, the controller may determine a pre-combustion temperature as described above. More specifically, the pre-combustion temperature may be determined by (a) detecting the pre-combustion temperature using one or more sensors; (b) calculating the pre-combustion temperature based on other information; or (c) determining a control metric (e.g., temperature of air intake) that is associated with the pre-combustion temperature. For example, the IVC timing and/or the compression ratio may be selected based on analysis of the data and/or other information. Engine parameters that may be analyzed in determining the IVC timing and/or the compression ratio include engine parameters that are set or fixed (e.g., by the hardware) when the dual-fuel engine is manufactured. Such engine parameters include, but are not limited to, air intake valve timing, volumetric efficiency, cam profile, and the like. The compression ratio may be a function of the IVC timing, and the IVC timing may be a function of the compression ratio.

Engine parameters may also include engine parameters determined or detected by the control system by sensors or calculations based on the data provided by the sensors. Such engine parameters are dynamic and include, but are not limited to, temperature of an air intake manifold, a temperature of an exhaust gas recirculating (EGR) manifold, a percentage of EGR versus outside air going to the air intake manifold, temperatures of turbochargers, temperatures of air exiting heat exchangers, engine speed, cylinder temperature, and the like. An EGR rate may be determined through one or more methods, including measuring with a flow meter, calculating based on intake mixture composition, or determining based on valve positions.

At 314, the controller may determine the IVC timing and/or the compression ratio based on the pre-combustion temperature. For example, a lookup table may be provided with the controller. The lookup table may retrieve at least one of an IVC timing and/or compression ratio based on the pre-combustion temperature. In a separate embodiment to that described above in relation to FIGS. 1 and 2, hardware can be added to the combustion chamber such that additional engine parameters are dynamic, including but not limited to air intake valve timing, volumetric efficiency, compression ratio and the like. In such an embodiment, during step 314, the control system can make the determination of the IVC timing. Similarly, other dynamic parameters of the engine can be determined and controlled by the controller to maximize efficiencies and minimize risk of knocking without falling outside of the scope of this disclosure.

At 316, the controller determines a substitution rate of the first and second fuels that are injected by the first and second injectors, respectively, based on data related to the engine parameters and other information. At 318, the controller then opens the intake valve and begins injecting a predetermined amount of the first fuel into the combustion chambers to mix with the air flowing through the intake valves. At 320, the controller closes the intake valves in accordance with the IVC timing. For example, the controller may close the intake valves at a crank angle prior to BDC. At 322, the controller injects a predetermined amount of the second fuel at the end of the compression stroke to ignite the mixtures of fuel and air to start the power stroke. The controller opens and closes the exhaust valves at 312 the same or similar as when operating in a single-fuel mode to begin a new cycle.

In an example of the method, when the engine operates in only a single-fuel mode the controller opens the intake valve and does not close the intake valve until BDC. As a result, the compression ratio in the cylinder is maximized; in one instance, a compression ratio of 15 is provided. Simultaneously, the controller does not inject a substitute fuel into the combustion chamber while air flows into the combustion chamber. During the compression stroke the combustion fuel is added at or near (within 5 crank angle degrees) of TDC to cause ignition of the mixture of the combustion fuel and air.

In a second example when the engine is operating in a dual-fuel mode the controller receives information from sensors that the air temperature at the intake manifold is 150° F. (65° C.) and that there is a 30% EGR rate. Based on this information the controller determines that the pre-combustion temperature at which a second fuel, that is a combustion fuel such as diesel fuel, is to be injected into the combustion chamber is 1225° F. (663° C.) to ensure the first fuel that is a substitute fuel does not combust before injection of the combustion fuel. The controller also determines that at a known volumetric efficiency of 75% that is inputted into the controller prior to operation of the engine and at the 1225° F. (662.8° C.) pre-combustion temperature the amount of the substitution fuel is 85% and the amount of the combustion fuel is 15% by the amount of energy each fuel causes during combustion in the cycle. In this example, the controller has a look-up table that indicates that in the 1220° F.-1230° F. (660° C.-665° C.) range and 75% volumetric efficiency an 85% substitution rate is required. After the intake valve opens, the controller has the first fuel injector inject the determined amount of the substitute fuel. The controller then closes the intake valve. Then at the end of the compression stroke, the controller causes the determined amount of combustion fuel to be injected by the second fuel injector to cause combustion to occur.

In another example of the method, when the engine operates in a dual-fuel mode and the controller receives information from sensors that the temperature of the air at the intake manifold is increasing and now 200° F. (93° C.) and that there remains a 30% EGR rate. Based on this information the controller calculates that the compressed temperature at which the combustion fuel is to be injected into the combustion chamber is 1000° F. (538° C.) to ensure the substitute fuel does not combust before injection of the combustion fuel as a result of the increased air temperature at the intake manifold. Thus, the controller calculates a decreased calculated pre-combustion temperature compared to the example where the intake manifold temperature is lower. The desired volumetric efficiency at this pre-combustion temperature is still 75%. The controller consequently determines that at 1000° F. (538° C.) pre-combustion temperature and a 75% volumetric efficiency the amount of the substitution fuel is 75% and the amount of the combustion fuel is 25% by the amount of energy each fuel causes during combustion in the cycle. After the intake valve opens, the controller has the first fuel injector inject the determined amount of the substitute fuel before injecting the second amount of fuel from the second fuel injector. Therefore, the controller accounts for the decrease in pre-combustion temperature prior to combustion by decreasing the percentage of substitute fuel.

In some embodiments, after the intake valve opens, the controller has the first fuel injector inject a calculated amount of the substitute fuel. The controller still closes the intake valve before bottom dead center and provides a compression ratio of 13. Thus, the compression ratio is decreased compared to the single-fuel mode to account for the substitute fuel, but increased compared to when more substitute fuel is provided. Therefore, the controller accounts for the increase in combustion fuel by increasing the compression ratio compared to when the engine utilizes a larger percentage of substitute fuel. A higher compression ratio and greater efficiency of the engine results compared to when the engine maximizes a substitute fuel.

In some embodiments, when the controller operates in a dual-fuel mode the controller monitors engine parameters including calculating engine efficiency and monitoring exhaust emissions and determines the EGR rate should be increased from 25% to 30%. Similarly, the controller determines the volumetric efficiency should increase from 75% to 85% during that same cycle. As a result of the increased EGR rate and other parameters in the engine, a calculated pre-combustion temperature for the engine cycle is determined. Then, based on the calculated pre-combustion temperature and volumetric efficiency, the intake valve is closed before BDC, the compression ratio is set and the amount of the first and second fuels is determined similar to other embodiments. Thus, the controller is able to determine the amount of exhaust flowing through an EGR valve to minimize emissions while still maximizing engine performance. EGR rate could be calculated using a flow meter, could be calculated based on intake mixture composition, or it could be determined by valve positions, for example.

Accordingly, in some embodiments, an engine may have a fixed cam/valve closure system that, during engine development, is designed to include a combination of intake cam and cylinder geometric compression ratio to allow for efficient operation in both diesel only and high substitution rate, dual-fuel operation. During operation, the engine operational and environmental conditions may alter the effective volumetric efficiency that change the in-cylinder pre-combustion temperature. In dual-fuel mode, the controller may use the in-cylinder pre-combustion temperature to adjust the substitution rate to substantially maximize the substitution while avoiding knocking.

In other embodiments, the intake valve closure (e.g., timing) and/or the geometric compression ratio may be controlled during operation. The pre-combustion temperature may be used to select an improved substitution rate/engine performance for a given operating and environmental condition.

With respect to the claims, the values and/or measurements that may be recited therein (e.g., fuel efficiency, BTE, fuel consumption, BSFC, substitution rate, compression ratio, IVC timing, and the like) are determined, if applicable, using established or industry-accepted methods, which may include methods set by industry trade groups (e.g., AAR), standards-setting bodies (e.g., International Organization for Standardization (ISO)), or governmental bodies (e.g., EPA).

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A dual-fuel engine system comprising:

a plurality of cylinders in which the cylinders of said plurality have an intake valve and an exhaust valve that control a flow of fluid into and out of a combustion chamber of the corresponding cylinder, the intake valve configured to have an intake valve closure (IVC) timing;

first and second fuel injectors configured to inject first and second fuels into the combustion chamber, wherein the dual-fuel engine system is configured to operate in a single-fuel mode in which only the second fuel is provided to the combustion chamber and a dual-fuel mode in which the first and second fuels are provided to the combustion chamber, the first fuel injector configured to inject the first fuel at a substitution rate;

a piston configured to move within the combustion chamber, wherein the combustion chamber and the piston are designed to provide a compression ratio; and one or more processors operably coupled to and configured to control operation of the first fuel injector, wherein the compression ratio and the IVC timing are selected to achieve a target pre-combustion temperature, the target pre-combustion temperature permitting the dual-fuel engine system to operate at a high substitution rate in the dual-fuel mode and at a sufficient fuel efficiency in the single-fuel mode.

2. The dual-fuel engine system of claim 1, further comprising a heat exchanger and an exhaust gas recirculation (EGR) manifold that receives exhaust from the dual-fuel engine system, the heat exchanger cooling the exhaust to provide recirculated gas, wherein the recirculated gas is mixed with air from outside of the dual-fuel engine system and provided to the plurality of cylinders.

3. The dual-fuel engine system of claim 2, wherein the recirculated gas is provided to the plurality of cylinders at an EGR rate selected by the one or more processors.

4. The dual-fuel engine system of claim 3, wherein the first fuel injector is configured to control the substitution rate of the first fuel based on an operating pre-combustion temperature during operation.

5. The dual-fuel engine system of claim 4, wherein the one or more processors are configured to determine the operating pre-combustion temperature within the cylinders based on at least one of a temperature sensor at the air manifold, a temperature sensor in one of the one or more cylinders, or a temperature sensor at an exhaust gas recirculating manifold.

6. The dual-fuel engine system of claim 1, wherein the compression ratio is between 11 and 15.

7. The dual-fuel engine system of claim 1, wherein the intake valve is configured to close between 515-540 crank angle degrees of a 720 degree crank cycle or 620-645 crank angle degrees of a 720 degree crank cycle.

8. The dual-fuel engine system of claim 1, wherein a maximum percentage of the substitution rate is configured to be at least 75% for predetermined baseline conditions and the fuel efficiency in the single-fuel mode is at least 40% for predetermined baseline conditions.

9. The dual-fuel engine system of claim 1, wherein the compression ratio is a geometric compression ratio, the IVC timing and the geometric compression ratio being fixed based on hardware used to manufacture the dual-fuel engine system.

10. The dual-fuel engine system of claim 1, wherein at least one of the IVC timing and the compression ratio may be selected by the one or more processors during operation of the dual-fuel engine system.

11. A method of designing a dual-fuel engine, the method comprising:

providing a plurality of cylinders in which the cylinders of said plurality have an intake valve and an exhaust valve that are configured to control a flow of fluid into and out of a combustion chamber of the cylinder;

operably coupling first and second fuel injectors to the cylinders, the first and second fuel injectors configured to inject first and second fuels into the combustion chamber, wherein the dual-fuel engine system is configured to operate in a single-fuel mode in which only the second fuel is provided to the combustion chamber and a dual-fuel mode in which the first and second fuels are provided to the combustion chamber, the first fuel injector configured to inject the first fuel at a substitution rate;

providing a piston configured to move within the combustion chamber; and selecting a compression ratio and an intake valve closure (IVC) timing relative to each other to achieve a target pre-combustion temperature, the target pre-combustion temperature permitting the dual-fuel engine system to operate at a high substitution rate in the dual-fuel mode and at a sufficient fuel efficiency in the single-fuel mode.

12. The method of claim 11, further comprising operably coupling a heat exchanger and an exhaust gas recirculation (EGR) manifold that receives exhaust from the dual-fuel engine system, the heat exchanger configured to cool the exhaust from the dual-fuel engine system to provide recirculated gas such that the recirculated gas is mixed with air from outside of the engine and provided to the plurality of cylinders.

13. The method of claim 11, wherein the compression ratio is between 11 and 15.

14. The method of claim 11, wherein the intake valve is configured to close between 515-540 crank angle degrees of a 720 degree crank cycle or 620-645 crank angle degrees of a 720 degree crank cycle.

15. The method of claim 11, wherein the compression ratio is between 11 and 15, a maximum percentage of the substitution rate is configured to be at least 75%, and the fuel efficiency in the single-fuel mode is at least 40%.

16. The method of claim 11, wherein one or more processors are configured to select at least one of the IVC timing and the compression ratio during operation of the dual-fuel engine system.

17. The method of claim 11, wherein the first fuel injector is configured to control the substitution rate of the first fuel based on an operating pre-combustion temperature during operation.

18. A method of operating a dual-fuel engine comprising:

providing a dual-fuel engine system that includes a plurality of cylinders in which the cylinders have an intake valve and an exhaust valve that control a flow of fluid into and out of a combustion chamber of the cylinder, the dual-fuel engine system also including first and second fuel injectors configured to inject first and second fuels into the combustion chamber, the first fuel injector configured to inject the first fuel at a substitution rate, the dual-fuel engine system also including a piston configured to move within the combustion chamber; and operating the dual-fuel engine system in a single-fuel mode in which only a second fuel is provided to the combustion chamber and a dual-fuel mode in which the first and second fuels are provided to the combustion chamber;

wherein the cylinders have a compression ratio and the intake valves have an intake valve closure (IVC) timing that are selected to achieve a target pre-combustion temperature, the target pre-combustion temperature permitting the dual-fuel engine system to operate at a high substitution rate in the dual-fuel mode and at a sufficient fuel efficiency in the single-fuel mode.

19. The method of claim 18, wherein operating the dual-fuel engine system includes controlling an exhaust gas recirculation (EGR) rate of recirculated gas that is provided to the dual-fuel engine and controlling the substitution rate of the first fuel based on an operating pre-combustion temperature during operation.

20. The method of claim 18, wherein the compression ratio is between 11 and 15, wherein a maximum percentage of the substitution rate is configured to be at least 75%, and the intake valve is configured to close between 515-540 crank angle degrees of a 720 degree crank cycle about the axis of a crank shaft or 620-645 crank angle degrees of a 720 degree crank cycle.

* * * * *